US008588668B2

(12) United States Patent
Ishii et al.

(10) Patent No.: US 8,588,668 B2
(45) Date of Patent: Nov. 19, 2013

(54) FIXING DEVICE AND IMAGE FORMING APPARATUS INCORPORATING SAME

(75) Inventors: Kenji Ishii, Kanagawa (JP); Masaaki Yoshikawa, Tokyo (JP); Yoshiki Yamaguchi, Kanagawa (JP); Toshihiko Shimokawa, Kanagawa (JP); Naoki Iwaya, Tokyo (JP); Takahiro Imada, Kanagawa (JP); Yutaka Ikebuchi, Kanagawa (JP); Tetsuo Tokuda, Kanagawa (JP); Takamasa Hase, Kanagawa (JP); Takuya Seshita, Kanagawa (JP); Hiroshi Yoshinaga, Chiba (JP); Ippei Fujimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 324 days.

(21) Appl. No.: 12/929,930

(22) Filed: Feb. 25, 2011

(65) Prior Publication Data

US 2011/0229225 A1 Sep. 22, 2011

(30) Foreign Application Priority Data

Mar. 18, 2010 (JP) ..... 2010-061897

(51) Int. Cl.
*G03G 15/20* (2006.01)

(52) U.S. Cl.
USPC ..... 399/329; 399/122; 399/328; 219/216

(58) Field of Classification Search
USPC ..... 399/122, 320, 328, 329; 219/216
See application file for complete search history.

(56) References Cited

U.S. PATENT DOCUMENTS

| | | | | |
|---|---|---|---|---|
| 5,148,226 | A * | 9/1992 | Setoriyama et al. | 399/329 |
| 6,628,916 | B2 | 9/2003 | Yasui et al. | |
| 6,636,709 | B2 | 10/2003 | Furukawa et al. | |
| 6,713,734 | B2 * | 3/2004 | Suzuki | 219/619 |
| 6,734,397 | B2 * | 5/2004 | Kato et al. | 219/216 |
| 6,778,790 | B2 | 8/2004 | Yoshinaga et al. | |
| 6,778,804 | B2 | 8/2004 | Yoshinaga et al. | |
| 6,785,505 | B2 | 8/2004 | Yasui et al. | |

(Continued)

FOREIGN PATENT DOCUMENTS

| | | | |
|---|---|---|---|
| JP | 2884714 | B2 | 2/1992 |
| JP | 3298354 | B2 | 10/1996 |

(Continued)

OTHER PUBLICATIONS

English language abstract of JP-11-002982 which corresponds to JP-3592485-B2.

(Continued)

*Primary Examiner* — David Gray
*Assistant Examiner* — Francis Gray
(74) *Attorney, Agent, or Firm* — Harness, Dickey & Pierce P.L.C.

(57) ABSTRACT

A fixing device includes an endless belt-shaped fixing member formed into a loop and rotatable in a predetermined direction of rotation, a pressing member contacting an outer circumferential surface of the fixing member, a heater support assembly provided inside the loop formed by the fixing member, and a laminated heater supported by the heater support assembly and provided inside the loop formed by the fixing member. The laminated heater includes an elastic sheet contacting an inner circumferential surface of the fixing member with pressure generated by elasticity of bending of the elastic sheet to heat the fixing member.

9 Claims, 7 Drawing Sheets

(56) References Cited

U.S. PATENT DOCUMENTS

| | | | | |
|---|---|---|---|---|
| 6,792,240 | B2 * | 9/2004 | Shida et al. | 399/333 |
| 6,813,464 | B2 | 11/2004 | Amita et al. | |
| 6,864,461 | B2 * | 3/2005 | Okabayashi et al. | 219/216 |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 6,937,827 | B2 | 8/2005 | Katoh et al. | |
| 7,002,105 | B2 * | 2/2006 | Suzumi | 219/216 |
| 7,022,944 | B2 | 4/2006 | Yoshinaga et al. | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,379,698 | B2 | 5/2008 | Yoshinaga | |
| 7,437,111 | B2 | 10/2008 | Yamada et al. | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,546,049 | B2 | 6/2009 | Ehara et al. | |
| 7,570,910 | B2 | 8/2009 | Ishii | |
| 7,603,071 | B2 | 10/2009 | Sugiura et al. | |
| 7,702,271 | B2 | 4/2010 | Yamada et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,840,151 | B2 | 11/2010 | Fujimoto | |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0152405 | A1 * | 8/2003 | Takeuchi et al. | 399/328 |
| 2003/0165348 | A1 | 9/2003 | Amita et al. | |
| 2003/0183610 | A1 * | 10/2003 | Okabayashi et al. | 219/216 |
| 2003/0206758 | A1 | 11/2003 | Yasui et al. | |
| 2003/0215271 | A1 | 11/2003 | Yoshinaga et al. | |
| 2004/0013453 | A1 | 1/2004 | Shinshi et al. | |
| 2005/0025539 | A1 | 2/2005 | Yoshinaga | |
| 2005/0074251 | A1 | 4/2005 | Katoh et al. | |
| 2005/0095043 | A1 | 5/2005 | Yoshinaga et al. | |
| 2005/0163543 | A1 | 7/2005 | Satoh et al. | |
| 2005/0180786 | A1 | 8/2005 | Yamada et al. | |
| 2006/0029411 | A1 | 2/2006 | Ishii et al. | |
| 2006/0056891 | A1 * | 3/2006 | Hashiguchi et al. | 399/329 |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0165448 | A1 | 7/2006 | Yoshinaga | |
| 2006/0257183 | A1 | 11/2006 | Ehara et al. | |
| 2006/0285893 | A1 | 12/2006 | Ishii | |
| 2006/0285897 | A1 | 12/2006 | Sugiura et al. | |
| 2007/0014600 | A1 | 1/2007 | Ishii et al. | |
| 2007/0014603 | A1 | 1/2007 | Satoh et al. | |
| 2008/0063443 | A1 | 3/2008 | Yoshinaga et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2008/0253789 | A1 | 10/2008 | Yoshinaga et al. | |
| 2008/0317532 | A1 | 12/2008 | Ehara et al. | |
| 2009/0003867 | A1 | 1/2009 | Fujimoto | |
| 2009/0010687 | A1 | 1/2009 | Yamada et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shishi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0129268 | A1 * | 6/2011 | Ishii et al. | 399/333 |
| 2011/0176822 | A1 | 7/2011 | Ishii et al. | |
| 2011/0206427 | A1 * | 8/2011 | Iwaya et al. | 399/329 |

FOREIGN PATENT DOCUMENTS

| | | | |
|---|---|---|---|
| JP | 10213984 | A | 8/1998 |
| JP | 3592485 | B2 | 1/1999 |
| JP | 2002-333788 | | 11/2002 |
| JP | 2007334205 | A | 12/2007 |
| JP | 2008158482 | A | 7/2008 |
| JP | 2008-216928 | A | 9/2008 |
| JP | 2009-251311 | A | 10/2009 |

OTHER PUBLICATIONS

English language abstract of JP-08-262903 which corresponds to JP-3298354-B2.

English language abstract of JP-04-044075 which corresponds to JP-2884714-B2.

Chinese Office Action dated Feb. 28, 2013.

* cited by examiner

FIXING DEVICE AND IMAGE FORMING APPARATUS INCORPORATING SAME

PRIORITY STATEMENT

The present patent application claims priority from Japanese Patent Application No. 2010-061897, filed on Mar. 18, 2010 in the Japan Patent Office, which is hereby incorporated herein by reference in its entirety.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a flexible, endless fixing belt formed into a loop and a resistant heat generator provided inside the loop formed by the fixing belt to heat the fixing belt, to shorten a warm-up time or a time to first print (hereinafter also "first print time"). Specifically, the resistant heat generator faces the inner circumferential surface of the fixing belt across a slight gap through which radiation heat generated by the resistant heat generator is transmitted to the fixing belt. A pressing roller presses against a nip formation member also provided inside the loop formed by the fixing belt via the fixing belt to form a nip between the fixing belt and the pressing roller through which the recording medium bearing the toner image passes. As the recording medium bearing the toner image passes through the nip, the fixing belt heated by radiation heat generated by the resistant heat generator and the pressing roller together apply heat and pressure to the recording medium to fix the toner image on the recording medium.

With the above configuration, the slight gap provided between the resistant heat generator and the fixing belt prevents wear of the resistant heat generator and the fixing belt while at the same time providing the shortened warm-up time and the shortened first print time described above. Accordingly, even when the fixing belt rotates at a high speed, the resistant heat generator heats the fixing belt to a desired fixing temperature with reduced wear of the fixing belt and the resistant heat generator.

However, the above-described fixing device including the resistant heat generator and the fixing belt has a drawback in that rotation and vibration of the pressing roller repeatedly applies mechanical stress to the resistant heat generator via the fixing belt, which bends the resistant heat generator. The repeated bending of the metal resistant heat generator causes fatigue failure and concomitant breakage or disconnection of the wiring of the resistant heat generator, resulting in faulty heating of the fixing belt.

Moreover, the slight gap provided between the resistant heat generator and the fixing belt to prevent the resistant heat generator from pressing against the fixing belt may increase heat resistance between the resistant heat generator and the fixing belt and therefore decrease heat transmission efficiency of transmitting heat from the resistant heat generator to the fixing belt. Also, the mechanical stress applied by the pressing roller may cause a part of the resistant heat generator to contact the fixing belt while other parts of the resistant heat generator are isolated from the fixing belt, disturbing uniform heat transmission from the resistant heat generator to the fixing belt throughout the axial direction of the fixing belt and thus resulting in faulty fixing of the toner image on the recording medium.

SUMMARY

At least one embodiment may provide a fixing device that includes an endless belt-shaped fixing member, a pressing member, a heater support assembly, and a laminated heater. The fixing member is formed into a loop and is rotatable in a predetermined direction of rotation. The pressing member contacts an outer circumferential surface of the fixing member. The heater support assembly is provided inside the loop formed by the fixing member. The laminated heater is supported by the heater support assembly and provided inside the loop formed by the fixing member. The laminated heater includes an elastic sheet contacting an inner circumferential surface of the fixing member with pressure generated by elasticity of bending of the elastic sheet to heat the fixing member.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
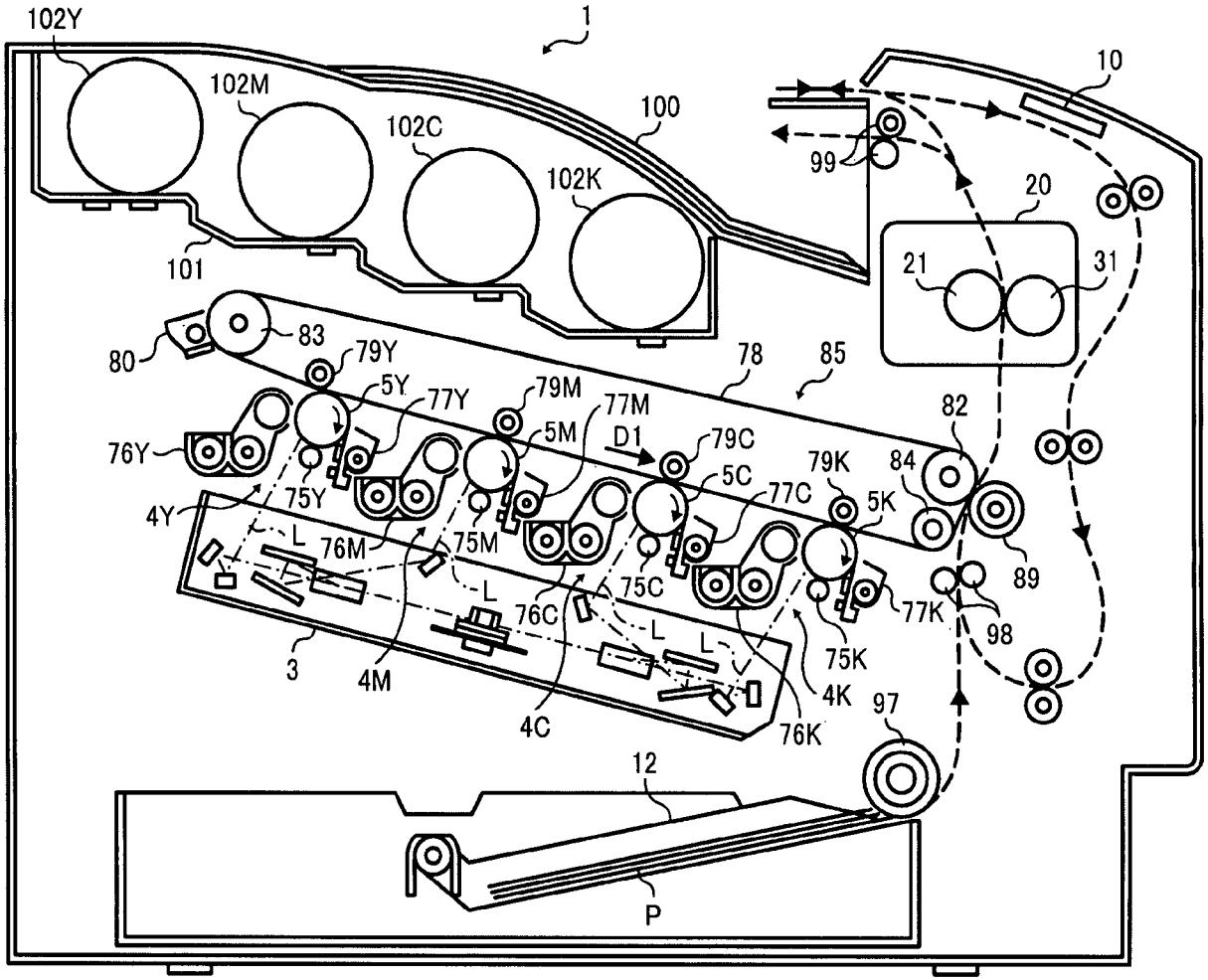
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this example embodiment of the present invention, the image forming apparatus 1 is a tandem color printer for forming a color image on a recording medium.

As illustrated in FIG. 1, the image forming apparatus 1 includes image forming devices 4Y, 4M, 4C, and 4K disposed in a center portion of the image forming apparatus 1, a toner bottle holder 101 disposed above the image forming devices 4Y, 4M, 4C, and 4K in an upper portion of the image forming apparatus 1, an exposure device 3 disposed below the image forming devices 4Y, 4M, 4C, and 4K, a paper tray 12 disposed below the exposure device 3 in a lower portion of the image forming apparatus 1, an intermediate transfer unit 85 disposed above the image forming devices 4Y, 4M, 4C, and 4K, a second transfer roller 89 disposed opposite the intermediate transfer unit 85, a feed roller 97 and a registration roller pair 98 disposed between the paper tray 12 and the second transfer roller 89 in a recording medium conveyance direction, a fixing device 20 disposed above the second transfer roller 89, an output roller pair 99 disposed above the fixing device 20, a stack portion 100 disposed downstream from the output roller pair 99 in the recording medium conveyance direction on top of the image forming apparatus 1, and a controller 10 disposed in the upper portion of the image forming apparatus 1.

The toner bottle holder 101 includes toner bottles 102Y, 102M, 102C, and 102K. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is disposed below the toner bottle holder 101, and includes an intermediate transfer belt 78 formed into a loop, four first transfer bias rollers 79Y, 79M, 79C, and 79K, a second transfer backup roller 82, a cleaning backup roller 83, and a tension roller 84, which are disposed inside the loop formed by the intermediate transfer belt 78, and an intermediate transfer cleaner 80 disposed outside the loop formed by the intermediate transfer belt 78. Specifically, the intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction D1.

The image forming devices 4Y, 4M, 4C, and 4K are arranged opposite the intermediate transfer belt 78, and form yellow, magenta, cyan, and black toner images, respectively. The image forming devices 4Y, 4M, 4C, and 4K include photoconductive drums 5Y, 5M, 5C, and 5K which are surrounded by chargers 75Y, 75M, 75C, and 75K, development devices 76Y, 76M, 76C, and 76K, cleaners 77Y, 77M, 77C, and 77K, and dischargers, respectively. Image forming processes including a charging process, an exposure process, a development process, a primary transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively, as a driving motor drives and rotates the photoconductive drums 5Y, 5M, 5C, and 5K clockwise in FIG. 1.

Specifically, in the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the respective photoconductive drums 5Y, 5M, 5C, and 5K according to image data sent from a client computer, for example. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the primary transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The following describes the transfer processes, that is, the primary transfer process described above and a secondary transfer process, performed on the intermediate transfer belt 78. The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, in the primary transfer process, the yellow, magenta, cyan, and black toner images formed on the photoconductive drums 5Y, 5M, 5C, and 5K, respectively, are primarily transferred and superimposed onto the intermediate transfer belt 78 rotating in the direction D1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The second transfer roller 89 is pressed against the second transfer backup roller 82 via the intermediate transfer belt 78 in such a manner that the second transfer roller 89 and the second transfer backup roller 82 sandwich the intermediate transfer belt 78 to form a second transfer nip between the second transfer roller 89 and the intermediate transfer belt 78. At the second transfer nip, the second transfer roller 89 secondarily transfers the color toner image formed on the intermediate transfer belt 78 onto a recording medium P sent from the paper tray 12 through the feed roller 97 and the registration roller pair 98 in the secondary transfer process. Thus, the desired color toner image is formed on the recording medium P. After the transfer of the color toner image, residual toner, which has not been transferred onto the recording medium P, remains on the intermediate transfer belt 78.

Thereafter, the intermediate transfer cleaner 80 collects the residual toner from the intermediate transfer belt 78 at a cleaning position at which the intermediate transfer cleaner 80 is disposed opposite the cleaning backup roller 83 via the intermediate transfer belt 78, thus completing a single sequence of transfer processes performed on the intermediate transfer belt 78.

The recording medium P is supplied to the second transfer nip from the paper tray 12 which loads a plurality of recording media P (e.g., transfer sheets). Specifically, the feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip.

After the secondary transfer process described above, the recording medium P bearing the color toner image is sent to the fixing device 20 that includes a fixing sleeve 21 and a pressing roller 31. The fixing sleeve 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 2:
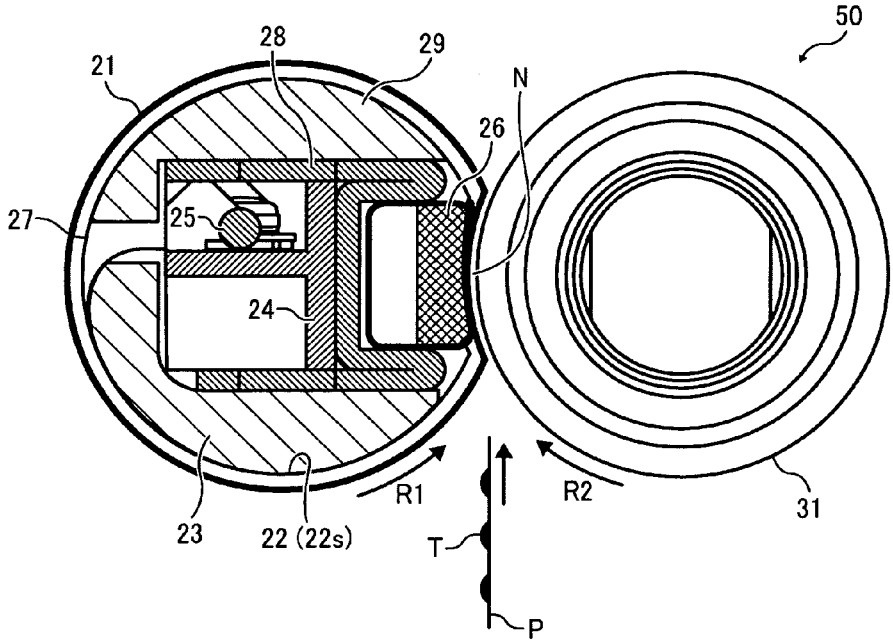
FIG. 2 is a vertical sectional view of a comparative fixing device.

Referring to FIG. 2, the following describes the structure of a comparative fixing device 50 that is comparative to the fixing device 20 depicted in FIG. 1.

FIG. 2 is a vertical sectional view of the comparative fixing device 50. As illustrated in FIG. 2, the comparative fixing device 50 includes the fixing sleeve 21 formed into a loop, a laminated heater 22, a heater support 23, a terminal stay 24, power supply wiring 25, a nip formation member 26, a fixing sleeve support 27, a core holder 28, and an insulation support 29, which are disposed inside the loop formed by the fixing sleeve 21, and the pressing roller 31 disposed outside the loop formed by the fixing sleeve 21.

As illustrated in FIG. 2, the fixing sleeve 21 is a rotatable endless belt serving as a fixing member or a rotary fixing member. The pressing roller 31 serves as a pressing member or a rotary pressing member that contacts an outer circumferential surface of the fixing sleeve 21. The nip formation member 26 faces an inner circumferential surface of the fixing sleeve 21, and is pressed against the pressing roller 31 via the fixing sleeve 21 to form a nip N between the pressing roller 31 and the fixing sleeve 21 through which the recording medium P bearing a toner image T passes. The laminated heater 22 faces and contacts the inner circumferential surface of the fixing sleeve 21 to heat the fixing sleeve 21. The heater support 23 faces the inner circumferential surface of the fixing sleeve 21 to support the laminated heater 22 at a predetermined position in such a manner that the laminated heater 22 is disposed between the heater support 23 and the fixing sleeve 21. The fixing sleeve support 27, formed into a loop, faces the inner circumferential surface of the fixing sleeve 21 and serves as a pipe-shaped fixing member support that supports the fixing sleeve 21 rotating in a rotation direction R1. The insulation support 29 is disposed inside the loop formed by the fixing sleeve support 27 at a position downstream from the nip N in the rotation direction R1 of the fixing sleeve 21 in such a manner that the insulation support 29 is disposed on an outer surface of the H-shaped core holder 28.

FIG. 2 illustrates the laminated heater 22 being isolated from the inner circumferential surface of the fixing sleeve 21 to distinguish the laminated heater 22 from the fixing sleeve 21. However, practically, the laminated heater 22 contacts the inner circumferential surface of the fixing sleeve 21 to heat the fixing sleeve 21 directly.

Figure 3A:
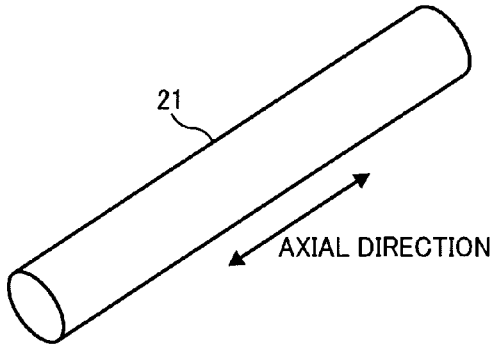
FIG. 3A is a perspective view of a fixing sleeve included in the comparative fixing device shown in FIG. 2.
Figure 3B:
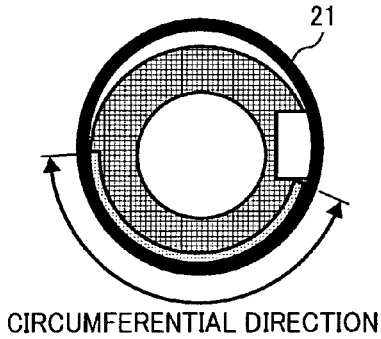
FIG. 3B is a vertical sectional view of the fixing sleeve shown in FIG. 3A.

Referring to FIGS. 3A and 3B, the following describes the fixing sleeve 21. FIG. 3A is a perspective view of the fixing sleeve 21. FIG. 3B is a vertical sectional view of the fixing sleeve 21. As illustrated in FIG. 3A, the fixing sleeve 21 is a flexible, pipe-shaped or cylindrical endless belt having a predetermined width in an axial direction of the fixing sleeve 21, which corresponds to a width of a recording medium P passing through the nip N formed between the fixing sleeve 21 and the pressing roller 31 depicted in FIG. 2. As illustrated in FIG. 3A, the axial direction of the pipe-shaped fixing sleeve 21 corresponds to a long axis, that is, a longitudinal direction, of the fixing sleeve 21. By contrast, as illustrated in FIG. 3B, a circumferential direction of the pipe-shaped fixing sleeve 21 extends along a circumference of the fixing sleeve 21 or in the rotation direction R1 of the fixing sleeve 21, orthogonal to the long axis of the fixing sleeve 21.

For example, the fixing sleeve 21 has an outer diameter of about 30 mm, and is constructed of a base layer made of a metal material and having a thickness in a range of from about 30 μm to about 50 μm, and at least a release layer provided on the base layer. The base layer of the fixing sleeve 21 is made of a conductive metal material such as iron, cobalt, nickel, an alloy of those, or the like. The release layer of the fixing sleeve 21 has a thickness in a range of from about 10 μm to about 50 μm, and is made of tetrafluoroethylene-perfluoroalkylvinylether copolymer (PFA), polytetrafluoroethylene (PTFE), polyimide, polyetherimide, polyether sulfide (PES), or the like. The release layer facilitates separation of toner of the toner image T on the recording medium P, which contacts the outer circumferential surface of the fixing sleeve 21 directly, from the fixing sleeve 21.

On the other hand, the pressing roller 31 depicted in FIG. 2 has an outer diameter of about 30 mm, and is constructed of a metal core made of a metal material such as aluminum or copper; a heat-resistant elastic layer provided on the metal core and made of silicon rubber (e.g., solid rubber); and a release layer provided on the elastic layer. The elastic layer has a thickness in a range of from about 2 mm to about 3 mm. The release layer is a PFA tube covering the elastic layer and has a thickness of about 50 μm. Optionally, a heat generator, such as a halogen heater, may be disposed inside the metal core as needed.

The pressing roller 31 is connected to a pressure control mechanism that applies pressure to the pressing roller 31 to cause the pressing roller 31 to contact the outer circumferential surface of the fixing sleeve 21 and releases the pressure to separate the pressing roller 31 from the fixing sleeve 21. Specifically, the pressure control mechanism applies pressure to the pressing roller 31 to press the pressing roller 31 against the nip formation member 26 via the fixing sleeve 21 in a state in which the pressing roller 31 contacts the outer circumferential surface of the fixing sleeve 21 to form the nip N between the pressing roller 31 and the fixing sleeve 21. For example, a portion of the pressing roller 31 contacting the fixing sleeve 21 causes a concave portion of the fixing sleeve 21 at the nip N. Thus, the recording medium P passing through the nip N moves along the concave portion of the fixing sleeve 21. By contrast, the pressure control mechanism releases the pressure applied to the pressing roller 31 to separate the pressing roller 31 from the outer circumferential surface of the fixing sleeve 21. Accordingly, the pressing roller 31 is not pressed against the nip formation member 26 via the fixing sleeve 21, and therefore the nip N is not formed between the pressing roller 31 and the fixing sleeve 21.

A driving mechanism drives and rotates the pressing roller 31, which presses the fixing sleeve 21 against the nip formation member 26, clockwise in FIG. 2 in a rotation direction R2. Accordingly, the fixing sleeve 21 rotates in accordance with rotation of the pressing roller 31 counterclockwise in FIG. 2 in the rotation direction R1 counter to the rotation direction R2.

A longitudinal direction of the nip formation member 26 is parallel to the axial direction of the fixing sleeve 21. At least a portion of the nip formation member 26 which is pressed against the pressing roller 31 via the fixing sleeve 21 is made of a heat-resistant elastic material such as fluorocarbon rubber. The core holder 28 holds and supports the nip formation member 26 at a predetermined position inside the loop formed by the fixing sleeve 21. Preferably, a portion of the nip formation member 26 which contacts the inner circumferential surface of the fixing sleeve 21 is made of a slidable and durable material such as Teflon® sheet.

The core holder 28 is made of sheet metal, and has a predetermined width in a longitudinal direction thereof, corresponding to the width of the fixing sleeve 21 in the axial direction of the fixing sleeve 21. The core holder 28 is an H-shaped rigid member in cross-section, and is disposed at substantially a center position inside the loop formed by the fixing sleeve 21.

The core holder 28 holds the respective components disposed inside the loop formed by the fixing sleeve 21 at predetermined positions. For example, the H-shaped core holder 28 includes a first concave portion facing the pressing roller 31, which houses and holds the nip formation member 26. In other words, the core holder 28 is disposed opposite the pressing roller 31 via the nip formation member 26 to support the nip formation member 26 at a back face of the nip formation member 26 disposed back-to-back to a front face of the nip formation member 26 facing the nip N. Accordingly, even when the pressing roller 31 presses the fixing sleeve 21 against the nip formation member 26, the core holder 28 prevents substantial deformation of the nip formation member 26. In addition, the nip formation member 26 held by the core holder 28 protrudes from the core holder 28 slightly toward the pressing roller 31 to isolate the core holder 28 from the fixing sleeve 21 without contacting the fixing sleeve 21 at the nip N.

The H-shaped core holder 28 further includes a second concave portion disposed back-to-back to the first concave portion, which houses and holds the terminal stay 24 and the power supply wiring 25. The terminal stay 24 has a predetermined width in a longitudinal direction thereof, corresponding to the width of the fixing sleeve 21 in the axial direction of the fixing sleeve 21, and is T-shaped in cross-section. The power supply wiring 25 extends on the terminal stay 24, and transmits power supplied from an outside of the comparative fixing device 50. A part of an outer circumferential surface of the core holder 28 holds the heater support 23 that supports the laminated heater 22. In FIG. 2, the core holder 28 holds the heater support 23 in a lower half region inside the loop formed by the fixing sleeve 21, that is, in a semicircular region provided upstream from the nip N in the rotation direction R1 of the fixing sleeve 21. The heater support 23 can be adhered to the core holder 28 to facilitate assembly. Alternatively, the heater support 23 may not be adhered to the core holder 28 to suppress heat transmission from the heater support 23 to the core holder 28. For example, the heater support 23 may be secured to the core holder 28 with screws.

A circumferential surface of the pipe-shaped fixing sleeve support 27 is cut along a longitudinal direction of the fixing sleeve support 27 parallel to the axial direction of the fixing sleeve 21. The core holder 28 fixedly supports the fixing sleeve support 27 in such a manner that the core holder 28 catches lateral end portions of the fixing sleeve support 27 in the longitudinal direction thereof. Specifically, each of the lateral end portions of the fixing sleeve support 27 is sandwiched between an upstream portion and a downstream portion of the core holder 28 from the nip N in the circumferential direction of the fixing sleeve 21 corresponding to the rotation direction R1 of the fixing sleeve 21. Both lateral ends of the fixing sleeve support 27 in the longitudinal direction thereof are supported by side plates of a frame (e.g., a chassis) of the comparative fixing device 50.

The heater support 23 supports the laminated heater 22 in such a manner that the laminated heater 22 contacts the inner circumferential surface of the fixing sleeve 21. Accordingly, the heater support 23 includes an arc-shaped outer circumferential surface having a predetermined circumferential length and disposed along the inner circumferential surface of the circular fixing sleeve 21 in cross-section.

Preferably, the heater support 23 has a heat resistance that resists heat generated by the laminated heater 22, a strength sufficient to support the laminated heater 22 without being deformed by the fixing sleeve 21 even when the rotating fixing sleeve 21 contacts the laminated heater 22, and a sufficient heat insulation so that heat generated by the laminated heater 22 is not transmitted to the core holder 28 but is transmitted to the fixing sleeve 21. For example, the heater support 23 may be molded foam made of polyimide resin.

The rotating fixing sleeve 21 pulls the laminated heater 22, which contacts the inner circumferential surface of the fixing sleeve 21, to the nip N. Accordingly, the heater support 23 need to have a strength sufficient to support the laminated heater 22 without being deformed by the laminated heater 22 pulled by the rotating fixing sleeve 21. To meet this requirement, molded foam made of polyimide resin is used. Alternatively, a supplemental solid resin member may be provided inside the molded foam made of polyimide resin to improve rigidity.

Figure 4:
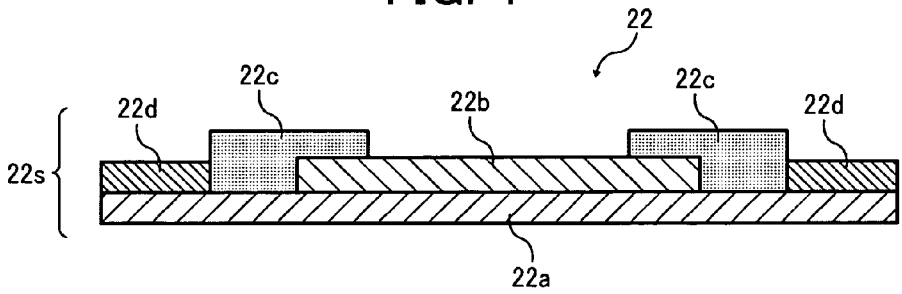
FIG. 4 is a horizontal sectional view of a laminated heater included in the comparative fixing device shown in FIG. 2.

Referring to FIG. 4, the following describes the laminated heater 22. FIG. 4 is a horizontal sectional view of the laminated heater 22. As illustrated in FIG. 4, the laminated heater 22 includes a heat generation sheet 22*s* constructed of a base layer 22*a* having insulation; a resistant heat generation layer 22*b* disposed on the base layer 22*a* and including conductive particles dispersed in a heat-resistant resin; an electrode layer 22*c* disposed on the base layer 22*a* to supply power to the resistant heat generation layer 22*b*; and an insulation layer 22*d* disposed on the base layer 22*a*. The heat generation sheet 22*s* is flexible, and has a predetermined width in the axial direction of the fixing sleeve 21 depicted in FIG. 3A and a predetermined length in the circumferential direction of the fixing sleeve 21 depicted in FIG. 3B. The insulation layer 22*d* insulates one resistant heat generation layer 22*b* from the adjacent electrode layer 22*c* of a different power supply system, and insulates an edge of the heat generation sheet 22*s* from an outside of the heat generation sheet 22*s*.

The laminated heater 22 further includes electrode terminals disposed at one edge of the heat generation sheet 22*s* and connected to the electrode layers 22*c* to supply power received from the power supply wiring 25 depicted in FIG. 2 to the electrode layers 22*c*.

The heat generation sheet 22*s* has a thickness in a range of from about 0.1 mm to about 1.0 mm, and has flexibility sufficient to wrap around the heater support 23 depicted in FIG. 2 at least along an outer circumferential surface of the heater support 23.

The base layer 22*a* is an elastic film made of a resin having a certain level of heat resistance, such as polyethylene terephthalate (PET) or polyimide resin. For example, the base layer 22*a* may be a film made of polyimide resin to provide heat resistance, insulation, and a certain level of flexibility.

The resistant heat generation layer 22*b* is a thin, conductive film in which conductive particles, such as carbon particles and metal particles, are uniformly dispersed in a heat-resistant resin such as polyimide resin. When power is supplied to the resistant heat generation layer 22*b*, internal resistance of the resistant heat generation layer 22*b* generates Joule heat. The resistant heat generation layer 22*b* is manufactured by coating the base layer 22*a* with a coating compound in which conductive particles, such as carbon particles and metal particles, are dispersed in a precursor made of a heat-resistant resin such as polyimide resin.

Alternatively, the resistant heat generation layer 22*b* may be manufactured by providing a thin conductive layer made of carbon particles and/or metal particles on the base layer 22*a* and then providing a thin insulation film made of a heat-resistant resin such as polyimide resin on the thin conductive layer. Thus, the thin insulation film is laminated on the thin conductive layer to integrate the thin insulation film with the thin conductive layer.

The carbon particles used in the resistant heat generation layer 22*b* may be known carbon black powder or carbon nanoparticles formed of at least one of carbon nanofiber, carbon nanotube, and carbon microcoil.

The metal particles used in the resistant heat generation layer 22*b* may be silver, aluminum, or nickel particles, and may be granular or filament-shaped.

The insulation layer 22*d* may be manufactured by coating the base layer 22*a* with an insulation material including a heat-resistant resin identical to the heat-resistant resin of the base layer 22*a*, such as polyimide resin.

The electrode layer 22*c* may be manufactured by coating the base layer 22*a* with a conductive ink or a conductive paste such as silver. Alternatively, metal foil or a metal mesh may be adhered to the base layer 22*a*.

The heat generation sheet 22*s* of the laminated heater 22 is a thin sheet having a small heat capacity, and is heated quickly. An amount of heat generated by the heat generation sheet 22*s* is arbitrarily set according to the volume resistivity of the resistant heat generation layer 22*b*. In other words, the amount of heat generated by the heat generation sheet 22*s* can be adjusted according to the material, shape, size, and dispersion of conductive particles of the resistant heat generation layer 22*b*. For example, the laminated heater 22 providing heat generation per unit area of 35 W/cm$^2$ outputs a total power of about 1,200 W with the heat generation sheet 22*s* having a width of about 20 cm in the axial direction of the fixing sleeve 21 and a length of about 2 cm in the circumferential direction of the fixing sleeve 21, for example.

If a metal filament, such as a stainless steel filament, is used as a laminated heater, the metal filament causes asperities to appear on a surface of the laminated heater. Consequently, when the inner circumferential surface of the fixing sleeve 21 slides over the laminated heater, the asperities of the laminated heater abrade the surface of the laminated heater easily. To address this problem, the heat generation sheet 22*s* has a smooth surface without asperities as described above, improving durability in particular against wear due to sliding of the inner circumferential surface of the fixing sleeve 21 over the laminated heater 22. Further, a surface of the resistant heat generation layer 22*b* of the heat generation sheet 22*s* may be coated with fluorocarbon resin to further improve durability.

As illustrated in FIG. 2, the heat generation sheet 22*s* of the laminated heater 22 may face the inner circumferential surface of the fixing sleeve 21 in an arbitrary region in the circumferential direction of the fixing sleeve 21 between a position on the fixing sleeve 21 opposite the nip N via an axis of the fixing sleeve 21 and a position immediately upstream from the nip N in the rotation direction R1 of the fixing sleeve 21.

As illustrated in FIG. 2, when the fixing sleeve 21 rotates, the pressing roller 31 pulls the fixing sleeve 21 at the nip N. Accordingly, the pressing roller 31 applies tension to an upstream portion of the fixing sleeve 21 provided upstream from the nip N in the rotation direction R1 of the fixing sleeve 21. Consequently, the inner circumferential surface of the fixing sleeve 21 slides over the laminated heater 22 in a state in which the fixing sleeve 21 is pressed against the heater support 23. By contrast, the pressing roller 31 does not apply tension to a downstream portion of the fixing sleeve 21 provided downstream from the nip N in the rotation direction R1 of the fixing sleeve 21. Accordingly, the downstream portion of the fixing sleeve 21 remains slack, a situation that is exacerbated if the fixing sleeve 21 rotates faster and destabilizing the rotation of the fixing sleeve 21.

To address this problem, the comparative fixing device 50 includes the fixing sleeve support 27 disposed inside the loop formed by the fixing sleeve 21 to support at least the downstream portion of the rotating fixing sleeve 21.

Figure 5:
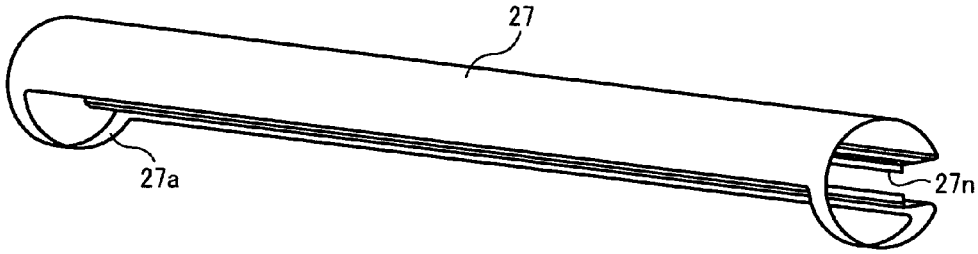
FIG. 5 is a perspective view of a fixing sleeve support included in the comparative fixing device shown in FIG. 2.

The pipe-shaped fixing sleeve support 27 is made of sheet metal, such as iron or stainless steel, having a thickness in a range of from about 0.1 mm to about 1.0 mm, for example. An outer diameter of the fixing sleeve support 27 is smaller than an inner diameter of the fixing sleeve 21 by a range of from about 0.5 mm to about 1.0 mm. The inner circumferential surface of the fixing sleeve 21 contacts an outer circumferential surface of the fixing sleeve support 27 at least between a position opposite the nip N via the axis of the fixing sleeve 21 and a position near an entry to the nip N in the rotation direction R1 of the fixing sleeve 21. As illustrated in FIG. 5, a part of the fixing sleeve support 27 which faces the nip N is cut along the longitudinal direction thereof parallel to the axial direction of the fixing sleeve 21 depicted in FIG. 2 into an opening 27*n* in such a manner that cut edges of the fixing sleeve support 27 are folded toward the core holder 28 depicted in FIG. 2 so that the cut edges do not contact the fixing sleeve 21 at the nip N.

Figure 6A:
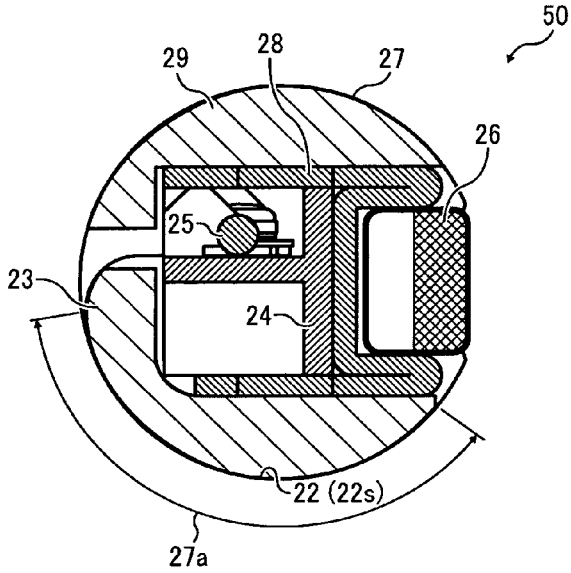
FIG. 6A is a vertical sectional view of inner components disposed inside the fixing sleeve shown in FIG. 3B.
Figure 6B:
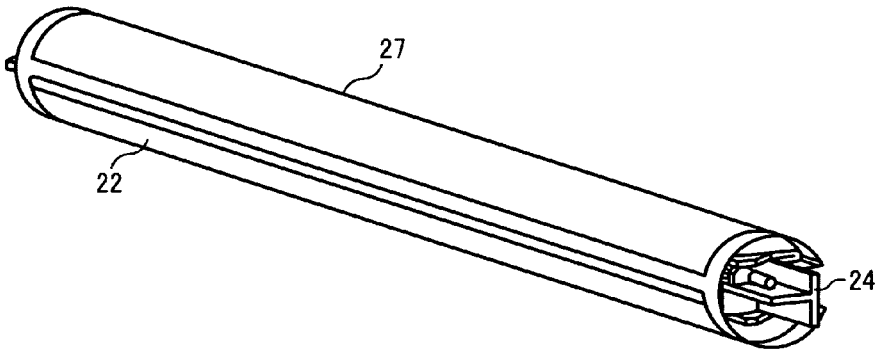
FIG. 6B is a perspective view of the inner components shown in FIG. 6A.

Further, another part of the fixing sleeve support 27 which faces the upstream portion of the fixing sleeve 21 provided upstream from the nip N in the rotation direction R1 of the fixing sleeve 21 is cut into an opening 27*a*. With this configuration, when the inner components of the comparative fixing device 50, which are disposed inside the loop formed by the fixing sleeve 21, are assembled as illustrated in FIGS. 6A and 6B, an outer circumferential surface of the laminated heater 22 is exposed entirely through the opening 27*a* to the inner circumferential surface of the fixing sleeve 21. For example, the outer circumferential surface of the laminated heater 22 and the outer circumferential surface of the fixing sleeve support 27 are provided on an identical virtual circumferential surface. Alternatively, the outer circumferential surface of the laminated heater 22 may protrude slightly toward the inner circumferential surface of the fixing sleeve 21 from the outer circumferential surface of the fixing sleeve support 27. Thus, the outer circumferential surface of the laminated heater 22 contacts the inner circumferential surface of the fixing sleeve 21.

In other words, the laminated heater 22 (e.g., the heat generation sheet 22*s*) supported by the heater support 23 contacts the inner circumferential surface of the fixing sleeve 21 to heat the fixing sleeve 21 effectively.

With the configuration described above, the fixing sleeve support 27 stabilizes rotation of the fixing sleeve 21. Moreover, the fixing sleeve 21 is supported by the rigid metal fixing sleeve support 27, facilitating installation of the fixing sleeve 21 inside the comparative fixing device 50.

The insulation support 29 (depicted in FIG. 6A) disposed at a position downstream from an exit of the nip N in the rotation direction R1 of the fixing sleeve 21 has a heat resistance that resists heat transmitted from the fixing sleeve 21 via the fixing sleeve support 27; a heat insulation that prevents heat transmission from the fixing sleeve support 27 contacting the fixing sleeve 21, and a strength that supports the fixing sleeve support 27 in such a manner that the fixing sleeve support 27 is not deformed by the rotating fixing sleeve 21 that contacts the fixing sleeve support 27. For example, the insulation support 29 is molded foam made of polyimide resin also used for the heater support 23.

Referring to FIGS. 1 and 2, the following describes operation of the comparative fixing device 50 having the above-described structure.

When the image forming apparatus 1 receives an output signal, for example, when the image forming apparatus 1 receives a print request specified by a user by using a control panel or sent from an external device, such as a client computer, the pressure control mechanism described above presses the pressing roller 31 against the nip formation member 26 via the fixing sleeve 21 to form the nip N between the pressing roller 31 and the fixing sleeve 21.

Thereafter, a driver drives and rotates the pressing roller 31 clockwise in FIG. 2 in the rotation direction R2. Accordingly, the fixing sleeve 21 rotates counterclockwise in FIG. 2 in the rotation direction R1 in accordance with rotation of the pressing roller 31. At the same time, the rotating fixing sleeve 21 rotates over the outer circumferential surface of the fixing sleeve support 27 in a state in which the pressing roller 31 pulls the upstream portion of the fixing sleeve 21 in the rotation direction R1 of the fixing sleeve 21 to the nip N and the inner circumferential surface of the fixing sleeve 21 contacts and slides over the heat generation sheet 22*s*.

Simultaneously, an external power source or an internal capacitor supplies power to the laminated heater 22 via the power supply wiring 25 to cause the heat generation sheet 22*s* to generate heat. The heat generated by the heat generation sheet 22*s* is transmitted effectively to the fixing sleeve 21 contacting the heat generation sheet 22*s* over the entire width of the fixing sleeve 21 in the axial direction thereof, so that the fixing sleeve 21 is heated quickly.

Alternatively, heating of the fixing sleeve 21 by the laminated heater 22 may not start simultaneously with driving of the pressing roller 31 by the driver. In other words, the laminated heater 22 may start heating the fixing sleeve 21 at a time different from a time at which the driver starts driving the pressing roller 31.

The controller 10 (e.g., a central processing unit (CPU) provided with a random-access memory (RAM) and a read-only memory (ROM)) controls heat generation of the laminated heater 22 based on a temperature of the fixing sleeve 21 detected by a temperature detector facing the fixing sleeve 21 at a position upstream from the nip N in the rotation direction R1 of the fixing sleeve 21 with or without contacting the fixing sleeve 21 so that the nip N is heated to a predetermined temperature desirable for fixing the toner image T on the recording medium P. After the fixing sleeve 21 is heated to the predetermined temperature, the recording medium P bearing the toner image T is conveyed to the nip N while the predetermined temperature is maintained.

In the comparative fixing device 50 described above, the fixing sleeve 21 and the laminated heater 22 have a small heat capacity, shortening a warm-up time and a first print time of the comparative fixing device 50 while saving energy. Further, the heat generation sheet 22*s* is a resin sheet. Accordingly, even when rotation and vibration of the pressing roller 31 applies mechanical stress to the heat generation sheet 22*s* repeatedly, and bends the heat generation sheet 22*s* repeatedly, the heat generation sheet 22*s* is not broken due to wear, and the comparative fixing device 50 operates for a longer time. Further, the fixing sleeve support 27 and the insulation support 29, which is optionally provided, improve stability in rotation of the fixing sleeve 21, facilitating high-speed rotation of the fixing sleeve 21.

However, in the comparative fixing device 50 having the above-described configuration, temperature variation may arise on the fixing sleeve 21 in the axial direction thereof, destabilizing fixing performance. Such temperature variation may be caused by uneven contact of the heat generation sheet 22*s* of the laminated heater 22 to the fixing sleeve 21 in the axial direction thereof, resulting in uneven heat transmission efficiency of the heat generation sheet 22*s* that transmits heat to the fixing sleeve 21. Moreover, the fixing sleeve 21 does not draw heat from a part of the heat generation sheet 22*s* which does not contact the fixing sleeve 21, resulting in overheating of the heat generation sheet 22*s* and malfunction of the comparative fixing device 50.

To address these problems, the heat generation sheet 22*s* of the laminated heater 22 may be pressed against the inner circumferential surface of the fixing sleeve 21 so that the heat generation sheet 22*s* contacts the fixing sleeve 21 uniformly throughout the axial direction of the fixing sleeve 21. For example, the heat generation sheet 22*s* may be pressed against the fixing sleeve 21 by substantial pressure to decrease heat resistance between the heat generation sheet 22*s* and the fixing sleeve 21. However, the substantial pressure may accelerate wear of an insulation protective layer of the heat generation sheet 22*s* or may increase load (e.g., friction) between the heat generation sheet 22*s* and the fixing sleeve 21 sliding over the heat generation sheet 22*s*, which disturbs rotation of the fixing sleeve 21.

Figure 7:
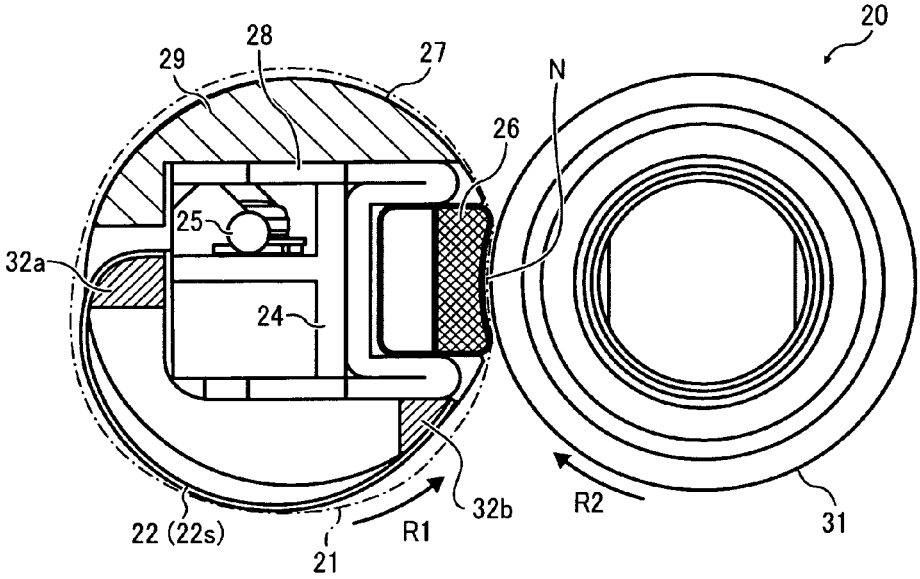
FIG. 7 is a vertical sectional view (according to an example embodiment) of a fixing device included in the image forming apparatus shown in FIG. 1.

Referring to FIG. 7, the following describes the fixing device 20 installed in the image forming apparatus 1 depicted in FIG. 1, which addresses the above-described problems.

FIG. 7 is a vertical sectional view of the fixing device 20. As illustrated in FIG. 7, the fixing device 20 includes the fixing sleeve 21, formed into a loop, serving as a flexible fixing member having an endless belt shape and rotating in the rotation direction R1, the pressing roller 31 serving as a pressing member contacting the outer circumferential surface of the fixing sleeve 21, the nip formation member 26 disposed inside the loop formed by the fixing sleeve 21 and pressed against the pressing roller 31 via the fixing sleeve 21 to form the nip N between the fixing sleeve 21 and the pressing roller 31, the laminated heater 22 disposed inside the loop formed by the fixing sleeve 21 and including the heat generation sheet 22*s* serving an elastic sheet that contacts the inner circumferential surface of the fixing sleeve 21 to heat the fixing sleeve 21. The outer circumferential surface of the laminated heater 22 is pressed against the inner circumferential surface of the fixing sleeve 21 by surface pressure generated by elasticity of bending of the elastic sheet of the laminated heater 22.

The fixing sleeve 21, the terminal stay 24, the power supply wiring 25, the nip formation member 26, the fixing sleeve support 27, the core holder 28, the insulation support 29, and the pressing roller 31 are identical to those of the comparative fixing device 50 depicted in FIG. 2. However, the configuration of the laminated heater 22 of the fixing device 20 is different from that of the laminated heater 22 of the comparative fixing device 50.

Figure 8:
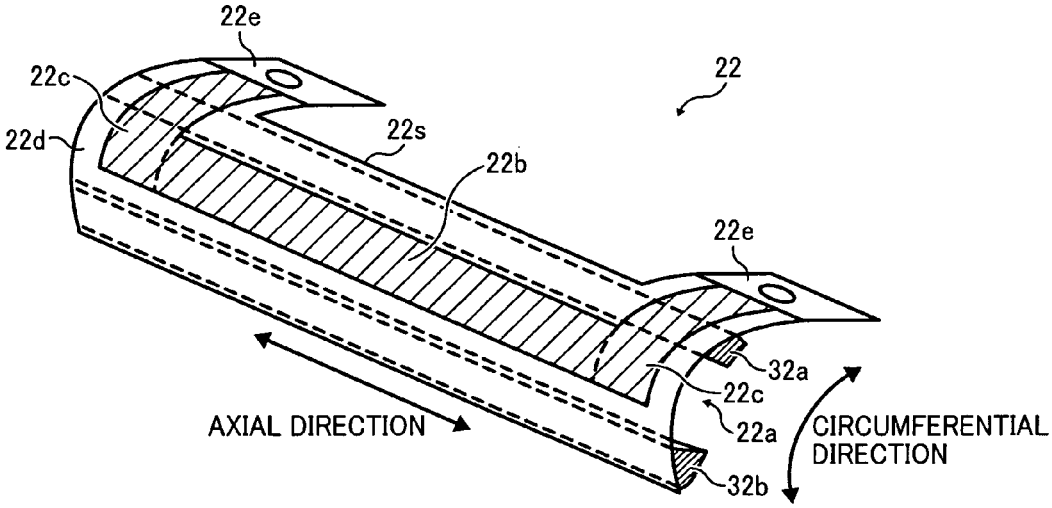
FIG. 8 is a perspective view (according to an example embodiment) of a laminated heater and heater supports included in the fixing device shown in FIG. 7.

Referring to FIGS. 7 and 8, the following describes the configuration of the laminated heater 22 of the fixing device 20. FIG. 8 is a perspective view of the laminated heater 22 and components that support the laminated heater 22. As illustrated in FIG. 7, the fixing device 20 further includes heater supports 32*a* and 32*b*, serving as a heater support assembly, which contact and support both ends of the laminated heater 22 in a circumferential direction of the laminated heater 22 corresponding to the circumferential direction of the fixing sleeve 21, respectively. In other words, the heater supports 32*a* and 32*b* do not contact and support an entire inner circumferential surface of the laminated heater 22 as the heater support 23 depicted in FIG. 2 does. For example, the bar-shaped heater supports 32*a* and 32*b* illustrated in FIG. 8 are attached to an inner circumferential surface of the heat generation sheet 22*s* of the laminated heater 22 at both ends of the heat generation sheet 22*s* in the circumferential direction of the laminated heater 22, respectively. Each of the heater supports 32*a* and 32*b* is made of a heat-resistant resin having a relatively small heat capacity, and has a long axis extending in the axial direction of the fixing sleeve 21. The heater supports 32*a* and 32*b*, serving as a heater support assembly that supports the laminated heater 22, are attached to predetermined first and second positions on the core holder 28 depicted in FIG. 7, respectively, to bend the laminated heater 22 in such a manner that the laminated heater 22 protrudes toward the fixing sleeve 21 as illustrated in FIG. 7. Specifically, the heater support 32*a* is mounted on the core holder 28 at the predetermined first position opposite the nip N via the axis of the fixing sleeve 21. By contrast, the heater support 32*b* is mounted on the core holder 28 at the predetermined second position near the entry to the nip N, that is, upstream from the nip N, in the rotation direction R1 of the fixing sleeve 21.

The heat generation sheet 22*s* of the laminated heater 22 has the basic structure illustrated in FIG. 4. Preferably, the resistant heat generation layer 22*b*, in which conductive particles are dispersed in a heat-resistant resin, is disposed on the base layer 22*a* serving as an elastic base. With this configuration, the heat generation sheet 22*s* is deformable as an elastic sheet. As illustrated in FIG. 7, the heater supports 32*a* and 32*b* support the heat generation sheet 22*s* at both ends thereof in a circumferential direction of the heat generation sheet 22*s* corresponding to the circumferential direction of the fixing sleeve 21, with a given clearance between the heater supports 32*a* and 32*b* that is shorter than a length of the heat generation sheet 22*s* in the circumferential direction thereof. Accordingly, the heat generation sheet 22*s* is bent uniformly throughout the circumferential direction thereof, that is, with a uniform curvature. When the laminated heater 22 with the bent heat generation sheet 22*s* is installed inside the fixing device 20, the heat generation sheet 22*s* is bent like a bow in such a manner that the heat generation sheet 22*s* protrudes from the fixing sleeve support 27 (depicted in FIG. 5) toward the fixing sleeve 21 through the opening 27*a* of the fixing sleeve support 27 as illustrated in FIG. 7.

Figure 9:
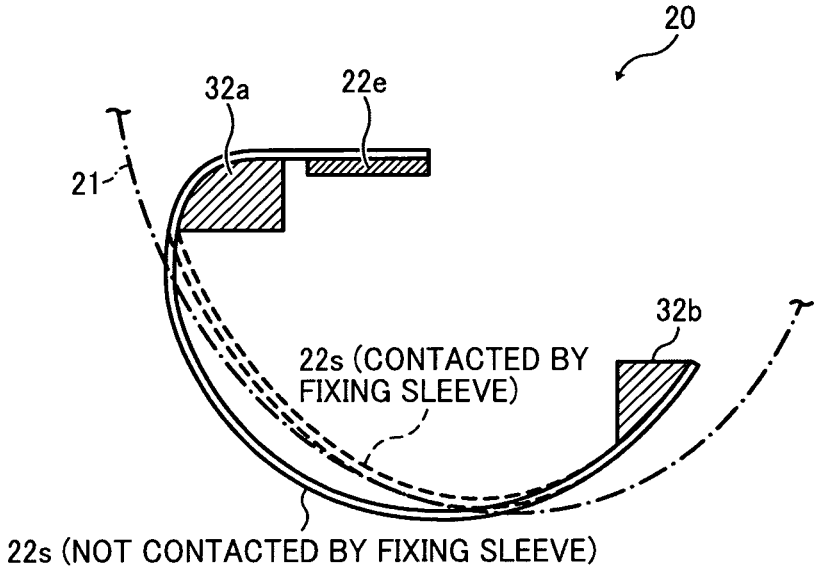
FIG. 9 is a partial sectional view (according to an example embodiment) of the fixing device shown in FIG. 7 illustrating a fixing sleeve and a heat generation sheet included in the fixing device.

Since the fixing sleeve 21 rotates over the outer circumferential surface of the fixing sleeve support 27, the inner circumferential surface of the fixing sleeve 21 constantly contacts an outer circumferential surface of the bent heat generation sheet 22*s* as illustrated in FIG. 9. Specifically, when the fixing sleeve 21 does not contact the heat generation sheet 22*s*, the heat generation sheet 22*s* is bent in cross-section as illustrated by the solid line in FIG. 9. By contrast, when the fixing sleeve 21 contacts the heat generation sheet 22*s*, the heat generation sheet 22*s* is bent in cross-section as illustrated by the broken line in FIG. 9. In other words, the fixing sleeve 21, which contacts the heat generation sheet 22*s*, presses the bent heat generation sheet 22*s* slightly toward the axis of the fixing sleeve 21 to balance tension of the fixing sleeve 21 with elasticity of bending of the heat generation sheet 22*s*, so that the fixing sleeve 21 contacts the heat generation sheet 22*s* with a constant surface pressure.

A track of the rotating fixing sleeve 21 is not constant and therefore a diameter of the fixing sleeve 21 and a position of the core holder 28 change slightly according to temperature of the fixing sleeve 21. However, a bent, curved section (e.g., a convex section or a folded, curved section) of the bent heat generation sheet 22*s* supported by the heater supports 32*a* and 32*b* at both ends of the heat generation sheet 22*s* in the circumferential direction thereof is maintained by elasticity of bending of the heat generation sheet 22*s*. Accordingly, even when the track of the rotating fixing sleeve 21 is changed, the heat generation sheet 22*s* contacts the fixing sleeve 21 properly. In other words, when the fixing sleeve 21 contacts the bent heat generation sheet 22*s*, elasticity of bending of the heat generation sheet 22*s*, which is substantially uniform throughout the surface thereof, causes the outer circumferential surface of the bent heat generation sheet 22*s* to contact the inner circumferential surface of the fixing sleeve 21 uniformly throughout the axial direction of the fixing sleeve 21 with light surface pressure applied by elasticity of bending of the heat generation sheet 22*s*. Further, the bent heat generation sheet 22*s* contacts the fixing sleeve 21 along the inner circumferential surface thereof even when the track of the rotating fixing sleeve 21 is changed in the circumferential direction thereof.

With the above-described configuration, the heat generation sheet 22*s* of the laminated heater 22 contacts the fixing sleeve 21 with reduced pressure. Accordingly, the fixing sleeve 21 is rotated with reduced torque without grease applied between the heat generation sheet 22*s* and the fixing sleeve 21 sliding over the heat generation sheet 22*s*. Further, even when the track of the rotating fixing sleeve 21 is changed, the fixing sleeve 21 contacts the heat generation sheet 22*s* stably, preventing overheating of the heat generation sheet 22*s* due to insufficient transmission from the heat generation sheet 22*s* to the fixing sleeve 21.

Figure 10:
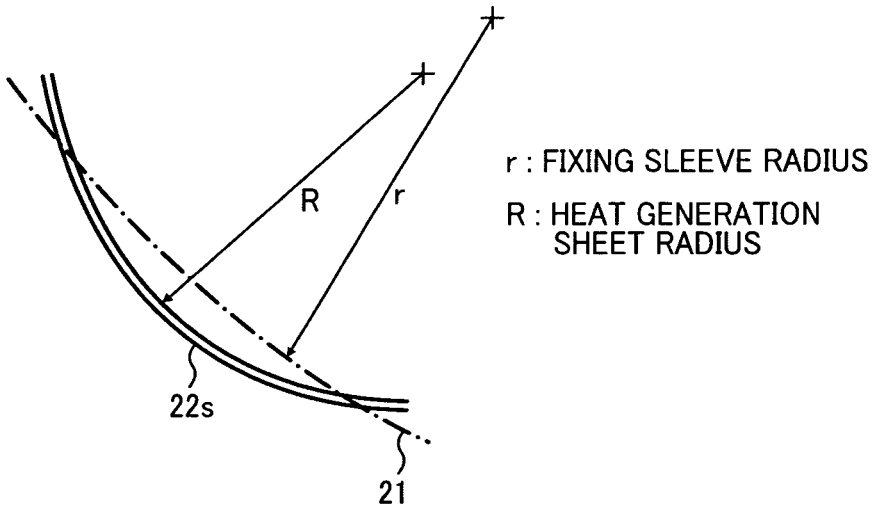
FIG. 10 is a partial sectional view (according to an example embodiment) of the fixing sleeve and the heat generation sheet shown in FIG. 9 illustrating curvature of the fixing sleeve and the heat generation sheet.

As illustrated in FIG. 10, a curvature of the heat generation sheet 22*s* bent in the circumferential direction of the fixing sleeve 21 (e.g., 1/R where R is a curvature radius of the bent heat generation sheet 22*s*) is greater than a curvature of the fixing sleeve 21 (e.g., 1/r where r is a curvature radius of the circular fixing sleeve 21). With this configuration, the fixing sleeve 21 contacts the bent heat generation sheet 22*s* properly.

As illustrated in FIG. 8, the laminated heater 22 further includes electrode terminals 22*e* disposed on an edge of the heat generation sheet 22*s* in one end of the heat generation sheet 22*s* provided with the heater support 32*a* in the circumferential direction of the fixing sleeve 21. The electrode terminals 22*e* connected to the electrode layers 22*c* (depicted in FIG. 4) are disposed at lateral ends of the heat generation sheet 22*s* in the axial direction of the fixing sleeve 21, respectively. When the laminated heater 22 is installed inside the fixing device 20, the electrode terminals 22*e* are connected to the power supply wiring 25 mounted on the terminal stay 24 depicted in FIG. 7.

Figure 11:
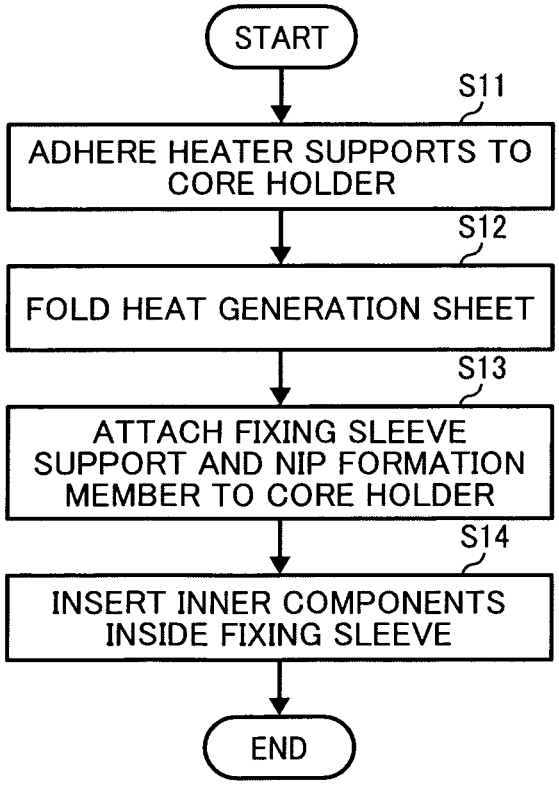
FIG. 11 is a flowchart (according to an example embodiment) illustrating processes of assembling inner components disposed inside a fixing sleeve included in the fixing device shown in FIG. 7.

Referring to FIGS. 7, 8, and 11, the following describes processes of assembling the inner components disposed inside the loop formed by the fixing sleeve 21. FIG. 11 is a flowchart illustrating the assembly processes.

In step S11, the heater supports 32*a* and 32*b* are adhered to the core holder 28 at the predetermined first and second positions thereof, respectively, with an adhesive while the heat generation sheet 22*s* of the laminated neater 22 is bent.

In step S12, the heat generation sheet 22*s* is folded at a position near the electrode terminals 22*e* depicted in FIG. 8 along an edge of the heater support 32*a* to direct the electrode terminals 22*e* to the axis of the circular fixing sleeve 21. Then, the electrode terminals 22*e* are secured to the terminal stay 24 with screws in such a manner that the electrode terminals 22*e* are connected to the power supply wiring 25.

In step S13, the fixing sleeve support 27 is attached to the core holder 28, and the nip formation member 26 is attached to the first concave portion of the core holder 28 facing the pressing roller 31, thus completing assembly of the inner components to be disposed inside the loop formed by the fixing sleeve 21.

In step S14, the inner components are inserted into the loop formed by the fixing sleeve 21 as illustrated in FIG. 7, completing the assembly processes of assembling the inner components disposed inside the loop formed by the fixing sleeve 21.

It is to be noted that either the flat heat generation sheet 22*s* with no load applied thereto or the heat generation sheet 22*s* bent in advance can be used in step S11. When the bent heat generation sheet 22*s* is used, the process of step S11 is facilitated. However, when the heat generation sheet 22*s* is bent in step S11, the heat generation sheet 22*s* may be twisted diagonally. To address this problem, the fixing device 20 further includes guides 32*g* as illustrated in FIGS. 12A and 12B.

Figure 12A:
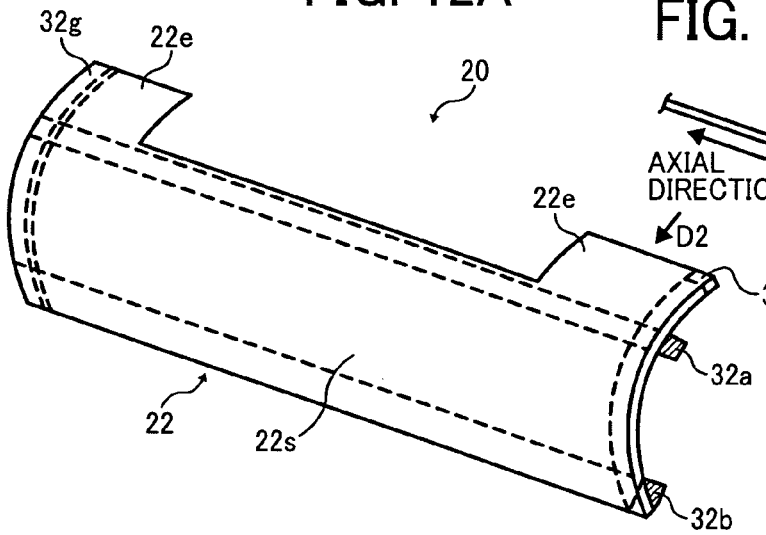
FIG. 12A is a perspective view (according to an example embodiment) of the laminated heater shown in FIG. 8 and guides attached thereto.
Figure 12B:
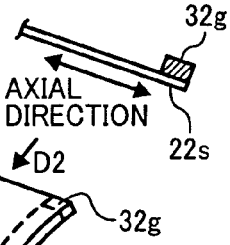
FIG. 12B is a partial sectional view (according to an example embodiment) of the guide and a heat generation sheet included in the laminated heater shown in FIG. 12A.

FIG. 12A is a perspective view of the laminated heater 22, the heater supports 32*a* and 32*b*, and the guides 32*g*. FIG. 12B is a partial sectional view of the heat generation sheet 22*s* and the guide 32*g* seen in a direction D2 in FIG. 12A. As illustrated in FIG. 12A, the guides 32*g* are attached to the inner circumferential surface of the heat generation sheet 22*s* back-to-back to the outer circumferential surface of the heat generation sheet 22*s* facing the fixing sleeve 21 at lateral ends of the laminated heater 22 in a longitudinal direction thereof parallel to the axial direction of the fixing sleeve 21 to maintain the bent shape of the heat generation sheet 22*s* so as to prevent twisting of the heat generation sheet 22*s*.

Referring to FIGS. 1 and 7, the following describes operation of the fixing device 20 having the above-described structure.

When the image forming apparatus 1 receives an output signal, for example, when the image forming apparatus 1 receives a print request specified by a user by using a control panel or sent from an external device, such as a client computer, the pressure control mechanism applies pressure to the pressing roller 31 to cause the pressing roller 31 to press the fixing sleeve 21 against the nip formation member 26 to form the nip N between the pressing roller 31 and the fixing sleeve 21. It is to be noted that even before rotation of the fixing sleeve 21 starts, the heat generation sheet 22*s* contacts the fixing sleeve 21 stably with reduced pressure therebetween.

Thereafter, a driver drives and rotates the pressing roller 31 clockwise in FIG. 7 in the rotation direction R2, thereby rotating the fixing sleeve 21 counterclockwise in FIG. 7 in the rotation direction R1 in accordance with rotation of the pressing roller 31. Specifically, the fixing sleeve 21 rotates over the outer circumferential surface of the fixing sleeve support 27 and at the same time rotates and slides over the outer circumferential surface of the heat generation sheet 22*s* in a state in which the heat generation sheet 22*s* contacts the fixing sleeve 21 with reduced pressure therebetween.

Simultaneously, an external power source or an internal capacitor supplies power to the laminated heater 22 via the power supply wiring 25 to cause the heat generation sheet 22*s* to generate heat. The heat generated by the heat generation sheet 22*s* is transmitted effectively to the fixing sleeve 21 contacting the heat generation sheet 22*s* over the entire width of the fixing sleeve 21 in the axial direction thereof, so that the fixing sleeve 21 is heated quickly. Alternatively, heating of the fixing sleeve 21 by the laminated heater 22 may not start simultaneously with driving of the pressing roller 31 by the driver. In other words, the laminated heater 22 may start heating the fixing sleeve 21 at a time different from a time at which the driver starts driving the pressing roller 31.

A temperature detector is disposed at a position upstream from the nip N in the rotation direction R1 of the fixing sleeve 21. For example, the temperature detector may be disposed outside the loop formed by the fixing sleeve 21 to face the outer circumferential surface of the fixing sleeve 21 with or without contacting the fixing sleeve 21. Alternatively, the temperature detector may be disposed inside the loop formed by the fixing sleeve 21. The temperature detector detects a temperature of the fixing sleeve 21 so that heat generation of the laminated heater 22 is controlled based on a detection result provided by the temperature detector to heat the nip N to a predetermined fixing temperature. When the nip N is heated to the predetermined fixing temperature, the fixing temperature is maintained, and a recording medium P is conveyed to the nip N.

In the fixing device 20 according to this example embodiment, the fixing sleeve 21 and the laminated heater 22 have a small heat capacity, shortening a warm-up time and a first print time of the fixing device 20 while saving energy. Further, the heat generation sheet 22*s* is a resin sheet. Accordingly, even when rotation and vibration of the pressing roller 31 applies mechanical stress to the heat generation sheet 22*s* repeatedly, and therefore bends the heat generation sheet 22*s* repeatedly, the heat generation sheet 22*s* is not broken due to wear, resulting in a longer operating life of the fixing device 20. Moreover, the heat generation sheet 22*s* contacts the fixing sleeve 21 with reduced pressure therebetween by using elasticity of bending of the heat generation sheet 22*s*. Accordingly, application of grease that facilitate sliding of the fixing sleeve 21 over the heat generation sheet 22*s* is not needed between the fixing sleeve 21 and the heat generation sheet 22*s*, resulting in rotation of the fixing sleeve 21 with reduced torque of the driver that drives and rotates the pressing roller 31. Additionally, the heat generation sheet 22*s* contacts the rotating fixing sleeve 21 stably over the entire width of the fixing sleeve 21, preventing overheating of the heat generation sheet 22*s* due to insufficient heat transmission from the heat generation sheet 22*s* to the fixing sleeve 21.

Usually, when the image forming apparatus 1 does not receive an output signal, the pressing roller 31 and the fixing sleeve 21 do not rotate and power is not supplied to the laminated heater 22 to save energy. However, in order to restart the fixing device 20 immediately after the image forming apparatus 1 receives an output signal, power can be supplied to the laminated heater 22 while the pressing roller 31 and the fixing sleeve 21 do not rotate. For example, power in an amount sufficient to keep the entire fixing sleeve 21 warm is supplied to the laminated heater 22.

In the fixing device 20 depicted in FIG. 7, the heater supports 32*a* and 32*b* support the bent heat generation sheet 22*s* at both ends of the heat generation sheet 22*s* in the circumferential direction thereof so that the inner circumferential surface of the fixing sleeve 21 contacts the bent heat generation sheet 22*s*. However, the configuration of the heater supports 32*a* and 32*b* is not limited to the configuration thereof illustrated in FIG. 7. Thus, referring to FIG. 13, the following describes another configuration of the heater supports 32*a* and 32*b*.

Figure 13:
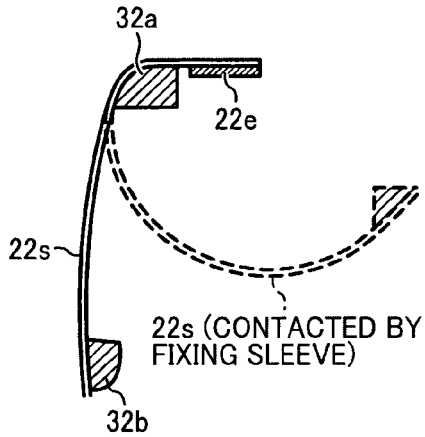
FIG. 13 is a vertical sectional view (according to an example embodiment) of the heat generation sheet shown in FIG. 9 and the heater supports shown in FIG. 8 illustrating one variation of a support method of the heater supports for supporting the heat generation sheet.

As illustrated in FIG. 13, only the heater support 32*a* attached to one end of the heat generation sheet 22*s* in the circumferential direction thereof is mounted on the core holder 28 depicted in FIG. 7, leaving the opposed end of the heat generation sheet 22*s* free so that the heat generation sheet 22*s* supported only by the heater support 32*a* contacts the inner circumferential surface of the fixing sleeve 21. Accordingly, the heat generation sheet 22*s* is not looped or bent but instead hangs from the heater support 32*a* straight downward or substantially straight downward as illustrated by the solid line in FIG. 13. Thereafter, the heat generation sheet 22*s* is bent as illustrated by the broken line in FIG. 13 and disposed inside the loop formed by the fixing sleeve 21.

Thus, even with the configuration in which one end of the heat generation sheet 22*s* in the circumferential direction thereof is attached to the heater support 32*a* mounted on the core holder 28, when the fixing sleeve 21 contacts the heat generation sheet 22*s*, the inner circumferential surface of the fixing sleeve 21 contacts the outer circumferential surface of the heat generation sheet 22*s* uniformly throughout the axial direction of the fixing sleeve 21 with reduced pressure therebetween generated by elasticity of bending of the heat generation sheet 22*s*. Accordingly, the fixing sleeve 21 is rotated with reduced torque of the driver that drives and rotates the pressing roller 31 that rotates the fixing sleeve 21. Further, the heat generation sheet 22*s* contacts the rotating fixing sleeve 21 stably over the entire outer circumferential surface of the heat generation sheet 22*s*, preventing overheating of the heat generation sheet 22*s* due to insufficient heat transmission from the heat generation sheet 22*s* to the fixing sleeve 21.

Figure 14:
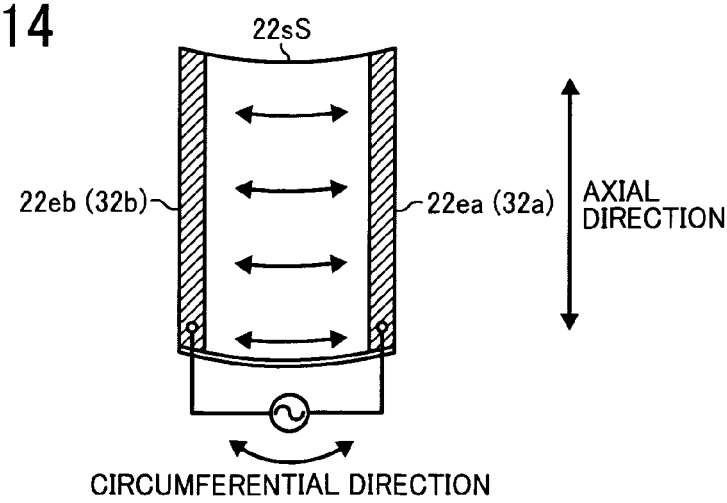
FIG. 14 is a plan view of a heat generation sheet included in the fixing device shown in FIG. 7 according to another example embodiment.

Preferably, the heater supports 32*a* and 32*b* disposed at both ends of the heat generation sheet 22*s* in the circumferential direction thereof are provided with electrode terminals. FIG. 14 is a plan view of a heat generation sheet 22*s*S including electrode terminals 22*ea* and 22*eb*. As illustrated in FIG. 14, the electrode terminals 22*e* a and 22*e* b are provided in the heater supports 32*a* and 32*b* disposed at both ends of the heat generation sheet 22*s*S in a circumferential direction thereof, respectively. For example, the heater supports 32*a* and 32*b* are mounted on the core holder 28 depicted in FIG. 7 at the predetermined first and second positions thereon, respectively, and then power supply wiring is extended from one end of each of the electrode terminals 22*ea* and 22*eb* in the axial direction of the fixing sleeve 21 toward an outside of the fixing sleeve 21 depicted in FIG. 7, so that the electrode terminals 22*ea* and 22*eb* are connected to a power source through the power supply wiring. Thus, power generated by the power source is supplied to the electrode layers 22*c* depicted in FIG. 4 of the heat generation sheet 22*s*S connected to the electrode terminals 22*ea* and 22*eb* through the electrode terminals 22*ea* and 22*eb*.

Referring to FIGS. 1 and 7, the following describes the effects of the fixing device 20 and the image forming apparatus 1 incorporating the fixing device 20.

In the fixing device (e.g., the fixing device 20) according to the above-described example embodiments, the outer circumferential surface of the laminated heater (e.g., the laminated heater 22), that is, an elastic member, contacts the inner circumferential surface of the fixing member (e.g., the fixing sleeve 21) stably with reduced surface pressure generated by elasticity of bending of the laminated heater. Accordingly, heat generated by the laminated heater is transmitted to the fixing member uniformly throughout the axial direction of the fixing member as the fixing member rotates with reduced torque without a lubricant (e.g., grease) applied between the fixing member and the laminated heater to facilitate sliding of the fixing member over the laminated heater.

Further, the fixing member and the laminated heater with a small heat capacity can shorten a warm-up time and a first print time of the fixing device while saving energy.

Further, since the heat generation sheet (e.g., the heat generation sheet 22*s*) of the laminated heater is a resin sheet, even when rotation and vibration of the pressing member (e.g., the pressing roller 31) applies mechanical stress to the heat generation sheet repeatedly, and bends the heat generation sheet repeatedly, the heat generation sheet is not broken due to wear, and the fixing device operates for a longer time.

In the image forming apparatus (e.g., the image forming apparatus 1) incorporating the fixing device, with the fixing member that rotates stably and receives heat from the laminated heater uniformly throughout the axial direction of the fixing member, even when the image forming apparatus forms a toner image at a high speed, the toner image is fixed on a recording medium properly.

In the fixing device 20 according to the above-described example embodiments, the pressing roller 31 is used as a pressing member. Alternatively, a pressing belt or the like may be used as a pressing member to provide the effects equivalent to those provided by the pressing roller 31. Further, the fixing sleeve 21 is used as a fixing member. Alternatively, an endless fixing belt, an endless fixing film, or the like may be used as a fixing member.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

an endless belt-shaped fixing member formed into a loop and rotatable in a predetermined direction of rotation;

a pressing member contacting an outer circumferential surface of the fixing member;

a heater support assembly provided inside the loop formed by the fixing member; and a laminated heater supported by the heater support assembly and provided inside the loop formed by the fixing member, comprising an elastic sheet contacting an inner circumferential surface of the fixing member with pressure generated by elasticity of bending of the elastic sheet to heat the fixing member.

2. The fixing device according to claim 1, further comprising a core holder provided inside the loop formed by the fixing member, wherein the heater support assembly comprises:

a first heater support mounted on the core holder at a first position thereof and attached to a first end of the elastic sheet of the laminated heater in the direction of rotation of the fixing member; and a second heater support mounted on the core holder at a second position thereof and attached to a second end of the elastic sheet of the laminated heater disposed opposite the first end in the direction of rotation of the fixing member, the first heater support and the second heater support supporting the elastic sheet in a state in which the elastic sheet is bent outward to produce a curved section and protrudes toward the fixing member.

3. The fixing device according to claim 2, wherein a curvature of the bent, curved section of the elastic sheet is greater than a curvature of the looped fixing member.

4. The fixing device according to claim 2, further comprising:

a first guide attached to an inner circumferential surface of the elastic sheet at a first lateral end of the elastic sheet in an axial direction of the fixing member; and a second guide attached to the inner circumferential surface of the elastic sheet at a second lateral end of the elastic sheet in the axial direction of the fixing member and parallel to the first guide, the first guide and the second guide supporting the bent elastic sheet.

5. The fixing device according to claim 1, wherein the elastic sheet of the laminated heater comprises:

a base layer; and a resistant heat generation layer disposed on the base layer and including conductive particles dispersed in a heat-resistant resin.

6. The fixing device according to claim 5, wherein the elastic sheet of the laminated heater further comprises an electrode layer disposed on the base layer and connected to the resistant heat generation layer to transmit power to the resistant heat generation layer.

7. The fixing device according to claim 6, wherein the laminated heater further comprises an electrode terminal disposed on one edge of the elastic sheet in the direction of rotation of the fixing member and connected to the electrode layer of the elastic sheet to transmit power to the electrode layer.

8. The fixing device according to claim 6, wherein each of the first heater support and the second heater support comprises an electrode terminal connected to the electrode layer of the elastic sheet to transmit power to the electrode layer.

9. An image forming apparatus comprising the fixing device according to claim 1.

* * * * *